United States Patent [19]

Nohe et al.

[11] 4,004,894

[45] Jan. 25, 1977

[54] OTTO CYCLE ENGINE FUELS CONTAINING DERIVATIVES OF CYCLIC POLYCARBOXYLIC ACIDS

[75] Inventors: Heinz Nohe, Meckenheim; Ernst Guenther Nottes, Limburgerhof, both of Germany

[73] Assignee: BASF Aktiengesellschaft, Ludwigshafen (Rhine), Germany

[22] Filed: Mar. 28, 1975

[21] Appl. No.: 563,051

Related U.S. Application Data

[63] Continuation-in-part of Ser. No. 417,127, Nov. 19, 1973, abandoned.

[30] Foreign Application Priority Data

Nov. 18, 1972 Germany ..... 2256690

[52] U.S. Cl. ..... 44/58; 44/66; 44/70

[51] Int. Cl.$^2$ ..... C10L 1/22

[58] Field of Search ..... 44/66, 63, 70, 58, 71

[56] References Cited

UNITED STATES PATENTS

| | | | |
|---|---|---|---|
| 1,908,705 | 5/1933 | Jaeger | 44/63 |
| 1,914,509 | 6/1933 | Jaeger | 44/63 |
| 1,941,689 | 1/1934 | Jaeger | 44/63 |
| 1,995,615 | 3/1935 | Jaeger | 44/63 |
| 2,236,590 | 4/1941 | Backoff et al. | 44/70 |
| 2,264,964 | 12/1941 | Backoff et al. | 44/70 |
| 3,320,041 | 5/1967 | Hemmingway | 44/70 |
| 3,374,174 | 3/1968 | LeSuer | 44/63 |
| 3,429,674 | 2/1969 | Hoke | 44/66 |
| 3,468,639 | 9/1969 | Lindstrom et al. | 44/66 |

*Primary Examiner*—Daniel E. Wyman
*Assistant Examiner*—Mrs. Y. Harris-Smith
*Attorney, Agent, or Firm*—Johnston, Keil, Thompson & Shurtleff

[57] ABSTRACT

Otto cycle engine fuels, for example gasoline, can be improved to such an extent by additives that no deposits or residues form in the carburetor or on the valves. In accordance with the invention esters, amides or imides of hydroaromatic polycarboxylic acids are added which are very effective in cleaning the carburetor and the valves.

7 Claims, No Drawings

OTTO CYCLE ENGINE FUELS CONTAINING DERIVATIVES OF CYCLIC POLYCARBOXYLIC ACIDS

This application is a continuation in part of application Ser. No. 417,127, filed Nov. 19, 1973, now abandoned.

The invention relates to Otto cycle engine fuels which contain a small amount of a derivative of a cyclic polycarboxylic acid as a carburetor cleaner.

It is desirable for the protection of the environment that the ratio of $CO_2$ to CO in the exhaust gas from Otto cycle engines should be as favorable as possible. This is feasible if the carburetor of a gasoline engine is kept as clean as possible. The fine and idle running jets of carburetors may be changed to such an extent after a fairly short time by deposits, dirt and oil mist originating from the lubricating oil of an Otto cycle engine that they no longer function completely effeciently. The result of this is that more carbon monoxide can be detected in the exhaust gas. By adding to the gasoline certain substances which are capable of cleaning away these residue the ratio $CO_2$ to CO can be favorably influenced. At the same time better combustion is achieved in the engine and less unburnt hydrocarbon residues pass into the exhaust gas.

It is therefore desirable that suitable measures should be taken to keep the carburetor of an automobile engine permanently clean, to prevent deposits on and in the carburetor components and in the case of soiled carburetors to achieve a cleaning effect and to wash away deposits and dirt from the carburetors by adding appropriate additives to the fuel.

Experiments with known surfactants which are soluble in oil and gasoline have hitherto met with only limited success. In particular derivatives of oleic acid, palm oil fatty acid and other fatty acids within the range of from 12 to 20 carbon atoms have been proposed for this purpose.

It is also known that acid amides of certain long chain aliphatic carboxylic acids with diamines and polyamines exhibit a very good washing effect in carburetors when added to the gasoline used. For example dissolving only 30 to 50 ppm of dioleic diethylene triamide in fuel is sufficient to substantially clean carburetors in current use if this substance is constantly added to the gasoline. Mixtures of esters of fatty acids and acid amides have also already been recommended and these exhibit a good cleaning action.

To achieve complete combustion of the fuel in the engine it is not however sufficient to keep the carburetor clean; the inlet valves also have to be kept clean. Many of the compounds hitherto found to be effective in cleaning the carburetor have the disadvantage that at the high temperatures prevailing they decompose on the seating of the inlet valves and may form deposits and encrustation thereon with the result that the running of the engine is upset. This is true for example of small additions of the abovementioned dioleic diethylene triamide which, as mentioned above, cleans carburetors efficiently when only a very small amount is added to the gasoline.

It is therefore the object of the invention to provide new substances which when added to gasoline not only clean the carburetor well but also do not tend to decompose at the hot inlet valves which are at a temperature of up to 350° C.

This object is achieved in accordance with the invention by the addition of derivatives of cyclic polycarboyxlic acids.

A fuel for an Otto cycle engine contains according to this invention a small amount of a cyclic polycarboyxlic acid of formula (I):

$$[A]\!\!-\!\!(COX)_m$$

in which A is the radical of a monocyclic, bicyclic or tricyclic non-aromatic polycarboxylic acid of a total of eight to sixteen carbon atoms including *m* carboxyl groups, *m* being from 3 to 6, X denotes identical or different substituents selected from the groups $OR^1$ and $$-\underset{\underset{R^3}{|}}{N}-R^2,$$

or any two X's together may be $$-\underset{|}{N}-R^4,$$

$OR^1$ is the radical of an alcohol of 1 to 20 carbon atoms, $$-\underset{\underset{R^3}{|}}{N}-R^2$$

is the radical of an aliphatic, cycloaliphatic, araliphatic or aromatic primary or secondary amine of one to thirty-six carbon atoms and $$-\underset{|}{N}-R^4$$

is the radical of a primary aliphatic, cycloaliphatic, araliphatic or aromatic amine of 1 to 20 carbon atoms with the proviso that at least two of the identical or different radicals $R^1$, $R^2$, $R^3$ and $R^4$ have each at least 8 carbon atoms.

Starting carboxylic acids for the derivatives to be added to the gasoline include monocyclic, bicyclic or tricyclic saturated or once or twice unsaturated tricarboxylic to hexacarboxylic acids of 8 to 16 carbon atoms. For example these cyclic carboxylic acids may contain the cyclobutane, cyclopentane, cyclohexane, cycloheptane or cyclooctane ring, the bicycloheptane, bicyclooctane, bicyclononane or bicyclodecane system or the tricyclononane, tricyclodecane, tricycloundecane or tricyclododecane system. For example cyclopentane derivatives may be otained by oxidation of bicycloheptene derivatives, cyclohexane derivatives by hydrogenation of the corresponding aromatic compounds or by oxidation of bicyclooctenes, bicyclooctenes by diene addition of cyclohexadiene compounds with dienophilic compounds such as maleic anhydride, and tricyclododecadiene derivatives by dimerization of cyclohexadienes.

These and other examples are known from the chemical literature.

Specific examples include cyclobutanetetracarboxylic acid, cyclopentanetetracarboxylic acid, cyclohexanetetracarboxylic acid, cyclohexanepentacarboxylic acid, cyclohexanehexacarboxylic acid, bicyclooctenetricarboxylic acid, bicyclooctenetetracarboxylic acid, bicyclooctanetetracarboxylic acid, tricyclododecadienetetracarboxylic acid and tricyclododenanetetracarboxylic acid.

Compounds having the following formulae are preferred:

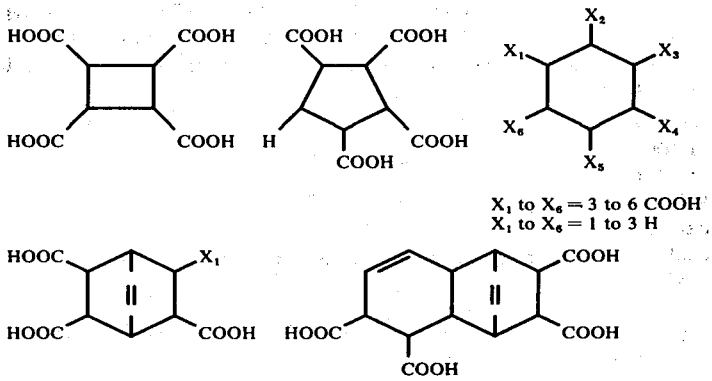

These compounds may be present in different isomeric forms.

The gasoline additives of formula (I) may be esters, amides, imides, esteramides, esteramidimides, esterimides or amidimides. Furthermore it is not essential to use uniform compounds but mixtures of the said derivatives may be added to the fuels.

Esters and esteramides are preferred from among the said derivatives.

Particularly suitable alcohol components for the esters to be used are alkanols of 1 to 18 carbon atoms. In principle however unsaturated or cyclic aromatic or hydroaromatic alcohols and also alkylene oxide adducts may also be used. The said alcohols may also bear substituents provided they do not impair solubility in the gasoline or combustion in the engine.

Specific alcohol components are methyl, ethyl, isopropyl, butyl, isobutyl, n-hexyl, 2-ethylhexyl, octyl, nonyl, decyl, undecyl; tridecyl, oleyl, palmityl and stearyl alcohols, cyclohexanol and benxyl alcohol. Mixtures of isomers may also be used. Mixtures of alcohols, for example $C_9$ and $C_{11}$ alcohols such as occur in the oxo synthesis, may also be used.

Cetyl alcohols, myristyl, isononyl, ethyldecyl, nonylbenzyl, tetramethylethyl, eicosyl, diisononyl and propyldodecyl alcohols are also suitable.

The esters, insofar as they are not known from the chemical literature, may be conveniently prepared by heating the free acid, anhydride or anhydride-acid (for example cyclohexane hexacarboxylic acid dianhydride) in a suitable solvent, for example dimethylformamide, with an excess of alcohol for several hours in the presence or absence of a catalyst. The water formed is then removed by heating, for example by entrainment with toluene or xylene. After the reaction is over the solvent is distilled off and the residue is blown out with steam. The reaction products should be completely esterified and no free carboxyl groups should be contained therein. Any small proportion of free carboxyl groups present because of incomplete esterification is therefore expediently converted into ammonium salts. The following esters obtainable in this way are preferred: the tetra-2-ethylhexyl ester of bicyclooctenetetracarboxylic acid, the tetradodecyl ester of bicyclooctenetetracarboxylic acid. Particularly good results are obtained with the tetra-2-ethylhexyl ester of bicyclooctenetetracarboxylic acid.

The carboxyl groups in esteramides are partly esterified and partly amidated. For example in a tricarboxylic acid two ester groups and one amido groups or one ester group and two amido groups and in a tetracarboxylic acid from three ester and one amide groups to one ester and three amido groups and in a pentacarboxylic acid from four ester and one amide to one ester and four amido groups and in a hexacarboxylic acid from five ester and one amido to one ester and five amido groups may be present. The derivatives of formula (I) may however be pure amides or pure imides.

The primary or secondary amines on which the amido radicals are based are as a rule saturated linear compounds of two to thirty-six carbon atoms. Unsaturated or cyclic and also aromatic amines are however also suitable. Specific amines are as follows: ethylamine, propylamine, 2-ethylhexylamine, di-2-ethylhexylamine, tridecylamine, ditridecylamine, cyclohexylamine, n-hexylamine, laurylamine, aniline, and benzylamine. The following amines are also suitable: octylamine, nonylamine, decylamine, dihexylamine, undecylamine, dodecylamine, hexyloctylamine, diundecylamine, oleylamine, dioleylamine, isononylamine, dodecylbenzylamine, eicosylamine, palmitylamine, hexyldecylamine, and dicyclohexylamine, methylcyclohexylamine and ethylcyclohexylamine.

The alcohols described in detail above are suitable as the alcohols of the ester groups.

The esteramides are conveniently prepared by heating the free acid, anhydride or anhydride acid (for example the dianhydride of cyclohexanehexacarboxylic acid) in a suitable solvent, for example dimethylformamide, with the amount of alcohol appropriate to the desired degree of esterification for several hours in the presence or absence of a catalyst. Then the appropriate amount of amine is added and the water formed is removed by heating, for example by entrainment with toluene or xylene. After the reaction is over the solvent is distilled off and the residue is blown out with steam. The reaction products may be completely esterified and amidated or may contain free carboxyl groups according to the amount of alcohol and amine added.

The following esteramides obtainable in this way are preferred:

- the tri-2-ethyl ester tri-2-ethylhexyl amide of cyclohexanehexacarboxylic acid;
- the tri-2-ethylhexyl ester tri-n-hexylamide of cyclohexanehexacarboxylic acid;
- the tri-2-ethylhexyl ester tritridecylamide of cyclohexanehexacarboxylic acid;
- the tridecyl ester di-2-ethylhexamide of cyclohexane pentacarboxylic acid;
- the dinonyl ester dianilide of cyclopentanetetracarboxylic acid;
- the di-2-ethylhexyl ester dicyclohexylamide of bicyclooctenetetracarboxylic acid;
- the di-2-ethylhexyl ester di-2-ethylhexyl amide of bicyclooctenetetracarboxylic acid;
- the di-2-ethylhexyl ester di-n-hexylamide of bicyclooctenetetracarboxylic acid;
- the di-2-ethylhexyl ester ditridecylamide of bicyclooctenetetracarboxylic acid;
- the dioctyl ester benzylamide of bicyclooctenetricarboxylic acid;
- the dipentyl ester di-hexadecylamide of tricyclododecadienetetracarboxylic acid;
- the dinonyl ester di-n-hexylamide of cyclobutanetetracarboxylic acid.

The following compounds from among those mentioned above are particularly effective as heat-stable carburettor cleaners:

- bicyclooctene tetracarboxylic di-2-ethylhexyl ester di-2-ethylhexylamide;
- cyclohexanehexacarboxylic tri-2-ethylhexyl ester tri-2-ethylhexylamide; and
- cyclohexanehexacarboxylic tri-2-ethylhexyl ester tri-n-hexylamide.

Amides or imides of formula (I) are prepared by conventional methods.

Amides of formula (I) are conveniently prepared by heating the free acid, anhydride or anhydride-acid with or without a solvent with the amine in excess for several hours, distilling or entraining off the water formed and, after the reaction is over, removing any solvent and the excess of amine by a conventional method, for example by distillation.

The corresponding imides are formed by the same reaction if only the stoichiometric amount of amine is used instead of an excess of amine.

When compounds according to the invention contain some free carboxyl groups it appears to be expedient to add to the fuel which contains these compounds according to the invention at least an amount of amine (as for example a fatty acid diethylenetriamine, oleic acid dipropylenetriamine and di-oleic acid diethylenetriamine) equivalent to the free carboxyl groups so that free acid groups are no longer present.

A prerequisite for the use of these polycarboxylic acid compounds which has already been specified is their good solubility in oil and gasoline. It is therefore expedient to choose radicals $R^1$ and $R^4$ having the longest possible chains. Radicals are therefore chosen as a rule which contain more than eight carbon atoms and preferably from 9 to 18 carbon atoms. It is also convenient to use compounds of formula (I) which contain more than two of the long chain radicals per molecule, for example from three to six radicals of the alcohols and amines preferably having from nine to eighteen carbon atoms.

The compounds to be used according to the invention should conveniently have a minimum solubility of about 0.1 g/liter of gasoline and advantageously at least 1 g/l of gasoline. They may be conveniently added to the gasoline to be improved by first preparing a concentrate for example by means of a solubilizer such as toluene or a gasoline fraction having a higher proportion of aromatics, so that the concentrate may be continuously metered into the motor fuel, preferably in the refinery. This concentrate may contain other carburetor cleaner components, for example fatty acid amides or polyamides, but the amount should not be sufficient to cause the abovementioned carbonisation at the valves. The amount is as a rule less than 200 to 500 ppm in the finished fuel.

Fuels for Otto cycle engines are characterized by known properties. The range of their volatility extends at 100° F (37.8° C) from 6 lbs/sq. in. (0.41 bar) to 16 lbs/sq. in. (1.03 bar) and over a range of "50% point" in the ASTM D-86 test from 170° F (77° C) to 270° F (132° C). The ASTM end point of gasoline is from 350° F (176° C) to 450° F (232° C). Full specifications for gasolines are defined in detail in United States Federal Specification VV-M-561 a-2 30th October, 1954 as Fuel M, Regular and Premium Grades of classes A, B and C.

The particularly good thermal stability of the derivatives (I) to be used according to the invention may be proved by a simple test method. Measurements on automobile engines have shown that at the inlet valves of Otto cycle engines the prevailing temperatures during operation are generally from 300° toa maximum of 350° C.

To reproduce these conditions in laboratory tests a metal block is ground so that cavities are formed which are exactly equivalent to the valve seatings of an automobile engine. Small iron plates equivalent to the valve head are made to fit into these cavities. When the block is heated electrically the small plates are also heated. In each case sufficient of the substance to be tested is placed in the small plates for the end of the glass bulb of a thermometer to be dipped therein (for example 1000 mg). The metal block may be heated to any desired temperature between 250° and 350° C electrically with thermostatic regulation and kept at the same constant temperature for a long period.

If the small plate is weighed before and after the end of the thermal treatment, the loss in weight by decomposition is determined for example after treatment for 10 minutes, 15 minutes and 20 minutes at 300°, 320° and 350° C. In the case of unsuitable substances the residues after the thermal treatment are carbonized to such an extent that they will no longer dissolve in lubricating oil. When compounds according to the invention are subjected to the same thermal test the residues which remain after the thermal treatment are substantially soluble in lubricating oil.

At the same time the esters to be used according to the invention may also be mixed with the abovementioned dioleic acid amides and trioleic acid amides and then after the thermal testing a good solubility of the residue formed in lubricating oil is always achieved.

Corresponding results are given below:

EXAMPLE 1 a. The di-2-ethylhexyl ester ditridecylamide of bicyclooctenetetracarboxylic acid An original weight of 1000 mg is kept at a temperature of 350° C for twenty minutes in the air. After cooling a highly viscous residue of 642.3 mg is determined on the small plate. This residue is heated for an hour at 100° C with lubricating oil, then allowed to drip off and the oil residue is washed away with n-heptane. A residue of only 0.7 mg remains on the small plate.

Under the same test conditions the residue from the same amount of dioleic acid diethylene triamide is 752 mg of which 51 mg is insoluble in oil.

In the following Table column A gives the weight remaining from an original weight of 1000 mg after having been heated for ten minutes at 350° C. Column B gives the residual weight (insoluble residue) after washing with oil. In each case the weight is given in mg. (D) = decomposition.

TABLE

| | A | B |
|---|---|---|
| (b) tri-2-ethylhexyl ester trihexylamide of cyclohexanehexacarboxylic acid | 292 | 1.9 |
| (c) tri-2-ethylhexyl ester tritridecylamide of cyclohexanehexacarboxylic acid | 473 | 2.3 |
| (d) di-2-hexyl ester of bicyclooctene tetracarboxylic acid | 305 | 0–1 |
| (e) tetranonyl ester of bicyclooctene tetracarboxylic acid | 502 | 1–2 |
| (f) trinonyl bicyclooctenetricarboxylate | 411 | 1–2 |
| (g) dioleic acid diethylene triamide | 732 (D) | 61 |

EXAMPLE 2

The di-2-ethylhexyl ester di-2-ethylhexylamide of bicyclooctenetetracarboxylic acid 248 mg of bicyclooctenetetracarboxylic dianhydride is dissolved at about 60° C in 1500 ml of dimethylformamide and then 260 g of 2-ethylhexanol is added to the solution. The reaction mixture is heated for 12 hours at 145° to 150° C. Dimethylformamide is then distilled off in vacuo and the residue is dissolved in 1000 ml of xylene. Then 258 g of 2-ethylhexylamine is added and the mixture is boiled under reflux using a water separator. When 36 g of water has been separated the xylene is distilled off and the residue is blown out with steam. 705 g (96.5% of theory) of the esteramide is obtained; it is a viscous yellow liquid. The acid number is 10 and the nitrogen content is 3.75%.

EXAMPLE 3

The tri-2-ethylhexyl ester tri-n-hexylamide of cyclohexanehexacarboxylic acid As described in Example 2 348 g of cyclohexanehexacarboxylic trianhydride is reacted with 390 g of 2-ethylhexanol and 202 g of n-hexylamine. After blowing out with steam a viscous pale brown liquid is obtained. The yield is 836 g or 92% of theory. The acid number is 65 and the nitrogen content is 3.2%.

EXAMPLES 4 TO 9

The following compounds are prepared as described in Example 1. Column *a* gives the molar amount of acid or anhydride; *b* the molar amount of alcohol; *c* the molar amount of amine; *d* the percentage nitrogen content and *e* the acid number.

| | a | b | c | d | e |
|---|---|---|---|---|---|
| 4 tri-2-ethylhexyl ester tri-2-ethylamide of cyclohexanehexacarboxylic acid | 1 | 3 | 3 | 4.1 | 5–10 |
| 5 tri-2-ethylhexyl ester tritridecylamide of cyclohexanehexacarboxylic acid | 1 | 3 | 3 | 3.4 | 5–10 |
| 6 distearyl ester tetra-n-hexylamide of cyclohexanehexacarboxylic acid | 1 | 2 | 4 | 4.7 | 5–10 |
| 7 tritridecyl ester di-2-ethylhexylamide cyclohexanepentacarboxylic acid | 1 | 3 | 2 | 2.6 | 5–10 |
| 8 tridecyl ester di-2-ethylhexylamide of cyclohexanepentacarboxylic acid | 1 | 3 | 2 | 3.0 | 5–10 |
| 9 dinonyl ester dianilide of cyclopentane tetracarboxylic acid | 1 | 2 | 2 | 4.5 | 5–10 |
| 10 dinonyl ester di-n-hexylamide of cyclobutanetetracarboxylic acid | 1 | 2 | 2 | 4.3 | 5–10 |
| 11 di-2-ethylhexyl ester dicyclohexylamide of bicyclooctenetetracarboxylic acid | 1 | 2 | 2 | 4.2 | 5–10 |
| 12 di-2-ethylhexyl ester ditridecylamide of bicyclooctenetetracarboxylic acid | 1 | 2 | 2 | 3.2 | 5–10 |
| 13 di-2-ethylhexyl ester di-2-ethylhexylamide of bicyclooctenetetracarboxylic acid | 1 | 2 | 2 | 3.8 | 5–10 |
| 14 di-2-ethylhexyl ester di-n-hexylamide of bicyclooctenetetracarboxylic acid | 1 | 2 | 2 | 4.2 | 5–10 |
| 15 di-octyl ester anilide of bicyclo-bicyclooctenetricarboxylic acid | 1 | 2 | 1 | 2.6 | 5–10 |
| 16 di-2-ethylhexyl ester benzylamide of bicyclooctenetricarboxylic acid | 1 | 2 | 1 | 2.5 | 5–10 |
| 17 dipentyl ester dihexadecylamine of tricyclododecadienetetracarboxylic acid | 1 | 2 | 2 | 3.0 | 5–10 |

EXAMPLE 18

The di-2-ethylhexylimide of bicyclooctenetetracarboxylic acid 248 parts of bicyclooctenetetracarboxylic dianhydride is dissolved in 15,000 parts by volume of dimethylformamide at 60° C and then 258 parts of 2-ethylhexylamine is added. The reaction mixture is heated for about 8 hours at 140° to 150° C and then the solvent is distilled off in vacuo. After cooling 456 parts (97% of theory) of the imide is obtained as a solidified material having a flow point of 84° to 89° C, an acid number of 10 and a nitrogen content of 6.0%.

The following compounds are prepared as described in Example 18:

| | a | c | d | e |
|---|---|---|---|---|
| 19 cyclohexanehexacarboxylic tridecylimide | 1 | 3 | 5.0 | 5–10 |
| 20 bicyclooctenetetracarboxylic dibenzylimide | 1 | 2 | 6.5 | 5–10 |

EXAMPLE 21

Bicyclooctenetricarboxylic tritridecylamide 222 parts of bicyclooctenetricarboxylic anhydride is dissolved in 1000 parts by volume of dioxane and then 1000 parts by volume of dioxane and 630 parts of tridecylamine are introduced into the mixture heated to 100° C. The whole is then heated under reflux for 8 hours after which excess tridecylamine is distilled off in vacuo. After cooling a pasty material is obtained (755 parts = 92% of theory) with a nitrogen content of 5.4%.

EXAMPLE 22

Cyclohexanehexacarboxylic hexatridecylamide 174 parts of cyclohexanehexacarboxylic acid is dissolved in 1000 parts by volume of dimethylformamide and then 700 parts of tridecylamine in 600 parts by volume of dimethylformamide is introduced into the mixture heated to 130° C. After 54 parts of water has been separated the reaction solution is concentrated in vacuo, dimethylformamide and excess tridecylamine thus being separated. 674 parts (94% of theory) of a pasty material is obtained having a nitrogen content of 5.9% and an acid number of 7.

EXAMPLE 23

Cyclohexanehexacarboxylic hexa-2-ethylhexylamide 174 parts of cyclohexanehexacarboxylic acid is introduced in small portions into 775 parts of 2-ethylhexyl heated to 100° C. Within 8 hours 54 parts of water is entrained out. After excess amine has been distilled off the crystalline end product is washed with petroleum ether and dried. 456 parts (90% of theory) is obtained with a nitrogen content of 8.2% and an acid number of 8.

The following compound is obtained as described in Example 23:

| | a | c | d | e |
|---|---|---|---|---|
| 24 bicyclooctenetetracarboxylic 2-ethylhexylamide | 1 | 4 | 7.7 | 10 |

EXAMPLE 25

Bicyclooctenetricarboxylic 2-ethylhexylimide 2-ethylhexylamide 222 parts of bicyclooctenetricarboxylic anhydride and 129 parts of 2-ethylhexylamine are dissolved in 500 parts by volume of dimethylformamide and heated under reflux; 18 parts of water is distilled off within 4 hours. Another 129 parts of 2-ethylhexylamine is then added and again 18 parts of water is separated within 2 hours. After the solvent has been separated in vacuo there remains 430 parts (97% of theory) of imide-amide having a nitrogen content of 6.3% and an acid number of 7.

The following are obtained according to Example 25:

| | a | c | d | e |
|---|---|---|---|---|
| 26 bicyclooctenetetracarboxylic 2-ethylhexylimide di-2-ethylhexylamide | 1 | 3 | 7.0 | 5 |
| 27 bicyclooctenetetracarboxylic 2-ethylhexylimide di-n-hexylamide | 1 | 3 | 7.7 | 10 |

EXAMPLE 28

Bicyclooctenetetracarboxylic 2-ethylhexylimide di-2-ethylhexyl ester 248 parts of bicyclooctenetetracarboxylic acid is dissolved in 1500 parts by volume of dimethylformamide, 129 parts of 2-ethylhexylamine is added and the whole is heated under reflux at 150° C for four hours. 18 parts of water is thus eliminated. After the reaction is over 260 parts of 2-ethylhexanol is added and heating under reflux is continued for another 6 hours, another 18 parts of water thus being distilled off. The solvent is then distilled off in vacuo and 289 parts of esterimide is obtained having a nitrogen content of 2.3% and an acid number of 10.

The following are obtained following the procedure described in Example 28:

| | a | c | b | d | e |
|---|---|---|---|---|---|
| 29 bicyclooctenetricarboxylic 2-ethylhexylimide n-hexyl ester | 1 | 1 | 1 | 3.3 | 7 |
| 30 cyclohexanehexacarboxylic di-2-ethylhexylimide di-2-ethylhexyl ester | 1 | 2 | 2 | 3.7 | 10 |

When the compounds according to Examples 18 to 30 are subjected to the tests described in Example 1 they give similar results to those obtained in Example 1.

The fuels according to the invention may contain other additives, particularly prior art additives such as fatty acid amides, fatty acid polyamides, ethers of polyalkylene glycols or antifreeze agents, colorants and corrosion inhibitors.

Application Example 1

Fuels according to the invention are used in a BASF single cylinder test engine having a stroke volume of 332 ccm (bore 65 mm diameter; stroke 100 mm) in test runs of 50 hours duration at a constant speed of 2000 rpm and an hourly throughput of 1.6 liters of fuel. The engine is modified so that 10% of exhaust gas is returned to the crankcase beneath the oil level and is passed thence into the air filter on the suction side of the carburetor (Solex Type 26VFIS).

Classification is based on an evaluation known as a "demerit valuation" in which a carburetor and associated inlet system which is entirely devoid of deposit is given the value 10. In the case of soiling a lower valuation is given according to the extent and amount of soiling. The blank value (i.e. with no cleaning additive in the fuel) which is tantamount to "total soiling" is zero. Total soiling means complete covering of the surface contacted by the fuel in the venturi tube, in the region of the throttle valve of the carburetor and deposits at the inlet valve of the test engine. In the case of dioctyl phthalate and other dicarboxylic esters this demerit valuation shows a degree of soiling of 1 in the carburettor at 1000 ppm. After running for 50 hours the inlet valve is seriously fouled with black asphaltic residues.

When the test run (50 hours) is carried out with 500 ppm of cyclohexanehexacarboxylic hexa-2-ethylhexyl ester the carburettor is clean, i.e. the demerit valuation gives the value 10. The inlet valve is devoid of residue and has a very clean appearance. Similar results are obtained with 1000 ppm of cyclohexanehexacarboxylic tri-2-ethylhexyl ester tri-2-ethylhexylamide.

Application Example 2

A Fiat engine type 600 D is operated at idling speed with a Weber carburetor on an engine test bench. The mixture of fuel and air at the beginning of the test is controlled so that the exhaust gas contains from 3.7 to 4.4% by volume of carbon monoxide. The temperature of the cooling water is kept at 47° C ± 1° C. The fuel used is an unstabilized gasoline having a lead content of 0.4 g/l and contains cracked gasoline components.

In tests with the said fuel there occurs after about 15 hours of testing an increase in the carbon monoxide content attributable to deposits of dirt in the carburetor. Maximum values of up to 7.1% by volume of carbon monoxide are measured after 50 hours of testing.

When 100 ppm of cyclohexanehexacarboxylic hexa-2-ethylhexyl ester is mixed with the fuel and the engine is run under otherwise the same conditions no increase in the carbon monoxide content can be detected even after one hundred hours of testing. The inlet valves are also clean.

Application Example 3

Two automobiles of the 2.5 liter class of the same type and the same manufacturer and about the same distance travelled (± 8000 km) were operated as taxis during the same period in the same town with the same super gasoline and the same lubricating oil in each case. The vehicles had a mileage reading of 67,000 and 72,000 km and were found to be technically in satisfactory condition, particularly the engine.

In the case of the first vehicle operated with a fuel devoid of additive no decrease in the usual blackish deposits in the carburettor and in the intake system could be detected after travelling 15,000 km. When bicyclooctenetetracarboxylic di-2-ethylhexyl ester dibutylamide was added in an amount of 70 or 100 ppm respectively to the fuel of the second vehicle however there was a marked decrease in the fouling already present on the carburetor parts. After about another 5000 km travelled the dirt on the walls of the carburetor had almost disappeared. The inlet valves were clean.

We claim:

1. A liquid hydrocarbon fuel for an Otto cycle engine which contains a deposit and residue inhibiting amount of an oil-soluble and gasoline-soluble derivative of a cyclic polycarboxylic acid of the formula (I):

$$[A](COX)_m \qquad (I)$$

in which A is the radical of a monocyclic, bicyclic or tricyclic non-aromatic polycarboxylic acid of a total of eight to sixteen carbon atoms including *m* carboxyl groups, *m* being from 3 to 6, X denotes identical or different groups OR, OR is the radical of an alcohol of 1 to 20 carbon atoms with the proviso that at least two of the identical or different radicals R have each at least 8 carbon atoms.

2. A fuel as set forth in claim 1 containing a tetracarboxylic, pentacarboxylic or hexacarboxylic ester as the compound of formula (I).

3. A fuel as set forth in claim 1 containing an ester of a $C_8$ to $C_{20}$ alkanol as the compound of formula (I).

4. A fuel as set forth in claim 1 containing a derivative of cyclohexanehexacarboxylic acid, cyclohexanepentacarboxylic acid, cyclopentanetetracarboxylic acid, bicyclooctenetetracarboxylic acid, bicyclooctenetricarboxylic acid, tricyclododecadienetetracarboxylic acid or cyclobutanetetracarboxylic acid as the compound of formula (I).

5. A fuel as set forth in claim 1 which contains bicyclooctenetetra-2-ethylhexyl ester as the compound of formula (I).

6. A fuel as set forth in claim 1 which contains a compound of formula (I) in an amount of from 10 to 1000 ppm based on the fuel.

7. A fuel as set forth in claim 6, wherein said fuel is gasoline.

* * * * *